US011087733B1

(12) United States Patent
Abel

(10) Patent No.: US 11,087,733 B1
(45) Date of Patent: Aug. 10, 2021

(54) METHOD AND SYSTEM FOR DESIGNING A MODAL FILTER FOR A DESIRED REVERBERATION

(71) Applicant: Jonathan Stuart Abel, Menlo Park, CA (US)

(72) Inventor: Jonathan Stuart Abel, Menlo Park, CA (US)

( * ) Notice: Subject to any disclaimer, the term of this patent is extended or adjusted under 35 U.S.C. 154(b) by 0 days.

(21) Appl. No.: 16/558,012

(22) Filed: Aug. 30, 2019

Related U.S. Application Data

(63) Continuation-in-part of application No. 16/432,866, filed on Jun. 5, 2019, now Pat. No. 10,825,443, and a continuation-in-part of application No. 16/384,266, filed on Apr. 15, 2019, said application No. 16/432,866 is a continuation-in-part of application No. 16/030,789, filed on Jul. 9, 2018, now abandoned, application No. 16/384,266, which is a continuation of application No. 15/796,327, filed on Oct. 27, 2017, now Pat. No. 10,262,645, application No. 16/030,789, which is a continuation of application No. 15/201,013, filed on Jul. 1, 2016, now Pat. No. 10,019,980, application No. 15/796,327, which is a continuation of application No. 14/558,531, filed on Dec. 2, 2014, now Pat. No. 9,805,704.

(60) Provisional application No. 62/726,325, filed on Sep. 3, 2018, provisional application No. 62/188,299, filed on Jul. 2, 2015, provisional application No. 62/061,219, filed on Oct. 8, 2014, provisional application No. 61/913,093, filed on Dec. 6, 2013, provisional application No. 61/910,548, filed on Dec. 2, 2013.

(51) Int. Cl.
*G10H 5/02* (2006.01)

(52) U.S. Cl.
CPC ..... *G10H 5/02* (2013.01)

(58) Field of Classification Search
CPC ..... G10K 15/08; G10H 1/366; G10H 5/02; G10H 2210/265; G10H 2210/281; G10H 2210/295; G10H 2250/531
See application file for complete search history.

(56) References Cited

U.S. PATENT DOCUMENTS

| | | | |
|---|---|---|---|
| 2,230,836 | A | 2/1941 | Hammond |
| 3,267,197 | A | 8/1966 | Hurvitz |
| 4,099,027 | A | 7/1978 | Whitten |
| 5,491,754 | A | 2/1996 | Jot et al. |
| 5,502,747 | A | 3/1996 | McGrath |

(Continued)

OTHER PUBLICATIONS

S. Abel et al., A Modal Architecture for Artificial Reverberation with Application to Room Acoustics Modeling, 137 Conv. Audio Eng'g Soc'y (presented Oct. 9-12, 2014, Los Angeles, USA) (Year: 2014).*

(Continued)

*Primary Examiner* — Walter F Briney, III
(74) *Attorney, Agent, or Firm* — Foley & Lardner LLP

(57) ABSTRACT

Preparing a sum of complex exponentials in the form of a modal filter to approximate a given impulse response is considered, and a non-iterative solution is described. In one embodiment, the mode count, and the mode frequencies, dampings, and amplitudes are estimated using the generalized eigenvalues of Hankel matrices of samples of the given impulse response.

15 Claims, 9 Drawing Sheets

(56) References Cited

U.S. PATENT DOCUMENTS

| | | | |
|---|---|---|---|
| 5,748,513 | A | 5/1998 | Van Duyne |
| 6,284,965 | B1 | 9/2001 | Smith et al. |
| 9,805,704 | B1 | 10/2017 | Abel |
| 2008/0232603 | A1 | 9/2008 | Soulodre |
| 2009/0052682 | A1 | 2/2009 | Kuroiwa |
| 2009/0082691 | A1 | 3/2009 | Denison et al. |
| 2010/0144306 | A1 | 6/2010 | Karr |
| 2011/0064235 | A1 | 3/2011 | Allston |
| 2011/0305347 | A1 | 12/2011 | Wurm |
| 2012/0011990 | A1 | 1/2012 | Mann |
| 2013/0202125 | A1 | 8/2013 | De Sena et al. |
| 2016/0269828 | A1 | 9/2016 | Smith et al. |
| 2016/0275956 | A1 | 9/2016 | Lee et al. |
| 2017/0134854 | A1 | 5/2017 | Lindahl et al. |

OTHER PUBLICATIONS

Joice G. Philip and Trapti Jain, Estimation of Modal Parameters of Low Frequency Oscillations in Power System Using Hankels Total Least Square Method, 2018 IEEE Innovative Smart Grid Technologies—Asia (presented May 22-25, 2018, Singapore) (Year: 2018).*

Liqun Lin et al., Modal Parameter Identification Based on Singular Value Decomposition and Backward Prediction, 2010, 8th IEEE Int'l Conf. on Control and Automation (presented Jun. 9-11, 2010, Xiamen, China) (Year: 2010).*

Abel et al., "Luciverb: Iterated Convolution for the Impatient," Audio Engineering Society Convention 133, Oct. 2012, pp. 1-10.

Della Pietra et al., "On the Dynamic Behavior of Axially Excited Helical Springs," Meccanica, vol. 17, pp. 31-43, 1982.

Fletcher et al., "The Physics of Musical Instruments," 2nd ed., Springer, 2010, pp. 128-130.

Garcia, "Optimal Files Partition for Efficient Convolution with Short Input/output Delay," Audio Engineering Society Convention 113, Oct. 2002, pp. 1-9.

Garcia, "Optimal Filter Partition for Efficient Convolution with Short Input/output Delay," Audio Engineering Society Convention 113, Oct. 2002, pp. 1-9.

Gardner, "Efficient Convolution without Input-Output Delay," J. Audio Eng. Soc., vol. 43, No. 3, pp. 127-136, 1995.

Jot, "Digital Delay Networks for Designing Artificial Reverberators," in Audio Engineering Society Convention 90, Feb. 1991, pp. 1-17.

Karjalainen et al., "More about this reverberation science: Perceptually good late reverberation." Audio Engineering Society (2001).

Lee et al., "A Reverberator with Two-Stage Decay and Onset Time Controls," Audio Engineering Society Convention 129, preprint No. 8208, Nov. 2010, pp. 1-6.

Makivirta et al., "Low-Frequency Modal Equalization of Loudspeaker-Room Responses," AES 111, Sep. 2001.

Matthews et al., "Methods for Synthesizing Very High {Q} Parametrically Well Behaved Two Pole Filters," Proc. Swedish Musical Acoustics Conference, Aug. 2003, pp. 1-4.

Meinema et al., "A New Reverberation Device for High Fidelity Systems," J. Audio Eng. Soc., vol. 9, No. 4, pp. 284-289, 324-326, 1961.

Morse et al., "Theoretical Acoustics", Princeton University Press, 1987, pp. 467-607.

Schroeder, "Natural Sounding Artificial Reverberation," Audio Engineering society Convention 13, Oct. 1961, pp. 1-18.

Vallmaki et a., "Fifty Years of Artificial Reverberation," IEEE Transactions on Audio, Speech, and Language Processing, vol. 20, No. 5, pp. 1421-1448, Jul. 2012.

Vallmaki et al., "Fifty Years of Artificial Reverberation," IEEE Transactions on Audio, Speech and Language Processing, vol. 20, No. 5, pp. 1421-1448, Jul. 2012.

* cited by examiner

METHOD AND SYSTEM FOR DESIGNING A MODAL FILTER FOR A DESIRED REVERBERATION

CROSS-REFERENCE TO RELATED APPLICATIONS

The present application is a continuation-in-part of U.S. patent application Ser. No. 16/384,266 filed Apr. 15, 2019, which application is a continuation of U.S. patent application Ser. No. 15/796,327 filed Oct. 27, 2017, now U.S. Pat. No. 10,262,645, which application is a continuation of U.S. patent application Ser. No. 14/558,531, filed Dec. 2, 2014, now U.S. Pat. No. 9,805,704, which application claims priority to U.S. Provisional Patent Application Nos. 62/061,219 filed Oct. 8, 2014, 61/913,093 filed Dec. 6, 2013 and 61/910,548 filed Dec. 2, 2013. The present application is also a continuation-in-part of U.S. patent application Ser. No. 16/432,866, filed Jun. 5, 2019, which application is a continuation-in-part of U.S. patent application Ser. No. 16/030,789 filed Jul. 9, 2018, which application is a continuation of U.S. patent application Ser. No. 15/201,013 filed Jul. 1, 2016, now U.S. Pat. No. 10,019,980, which application claims priority to U.S. Provisional Patent Application No. 62/188,299 filed Jul. 2, 2015. The present application also claims priority to U.S. Provisional Patent Application No. 62/726,325 filed Sep. 3, 2018. The contents of all the above applications are incorporated herein by reference in their entirety.

TECHNICAL FIELD

The present embodiments relate generally to signal processing, particularly to systems having a parallel bank of resonant filters.

BACKGROUND

While acoustic spaces and vibrating systems have long been studied using modal analysis (e.g. A. Benade, Fundamentals of Musical Acoustics, Oxford University Press, 1976, pp. 172 et seq.), P. Morse and K. Ingard, Theoretical Acoustics, Princeton University Press, 1987, pp 576 et seq.), such systems have only recently been synthesized using modal structures (e.g. J. Abel et al., "A modal architecture for artificial reverberation," The Journal of the Acoustical Society of America, vol. 134, no. 5, p. 4220, 2013, J. Abel et al., "A modal architecture for artificial reverberation with application to room acoustics modeling," Audio Engineering Society Convention, vol. 137, (Los Angeles, Calif.), Oct. 9-12, 2014 ("Modal Architecture")). A feature is that a rational system can be represented as the linear combination of resonant or "mode" filters, one for each mode of the system. The resulting parallel structure allows accurate modeling of the acoustic space or object, and provides explicit, interactive control over its features.

One barrier to implementing such systems is estimating the parameters which describe each mode filter—its resonant frequency, damping, and amplitude—a task made difficult by the potentially thousands of modes needed to accurately characterize the desired acoustic space or vibrating system. In "Modal Architecture," room mode frequencies are approximated by the locations of peaks in the power spectrum of the impulse response. Mode dampings are approximated using reverberation times in bands about the estimated mode frequencies. Though this method is computationally efficient and appears to produce acceptable perceptual results, its accuracy can be improved, as spectral peaks and mode frequencies rarely coincide, and mode dampings can vary noticeably from mode to nearby mode.

In E. Maestre et al., "Design of recursive digital filters in parallel form by linearly constrained pole optimization," IEEE Signal Processing Letters, vol. 23, pp. 1547-1550, November 1997 and E. Maestre et al., "Constrained pole optimization for modal reverberation," in International Conference on Digital Audio Effects (DAFx-17), vol. 18, (Edinburgh, UK), Sep. 5-9, 2017, frequency bands containing relatively few spectral peaks are formed, and mode parameters (in these cases, biquad coefficients) are fit in each band using a nonlinear optimization. The method produces excellent fits to the spectrum, but requires significant computation, and is not easily automated.

Thus, there is a need for a method to estimate modal parameters from a given impulse response that is both accurate and computationally efficient. There is a need for a method to estimate modal parameters which also may be automated.

SUMMARY

According to certain aspects, the present embodiments estimate modal parameters from given impulse responses using a direct computation that is accurate, and can handle a large number of modes. In one embodiment, the pseudo-inverse of a Hankel matrix of the given impulse response samples is formed. In another embodiment, a Hankel matrix of offset impulse response samples is formed, and the generalized eigenvalues are computed to form frequency and damping parameters. In a further embodiment, mode amplitudes are estimated using linear least squares based on estimates of the mode frequency and damping parameters. In yet another embodiment, the impulse response is decomposed into a set of possibly overlapping frequency bands, and down-sampled in advance of estimating modal parameters for each band.

BRIEF DESCRIPTION OF THE DRAWINGS

These and other aspects and features of the present embodiments will become apparent to those ordinarily skilled in the art upon review of the following description of specific embodiments in conjunction with the accompanying figures, wherein.

DETAILED DESCRIPTION

Figure 1:
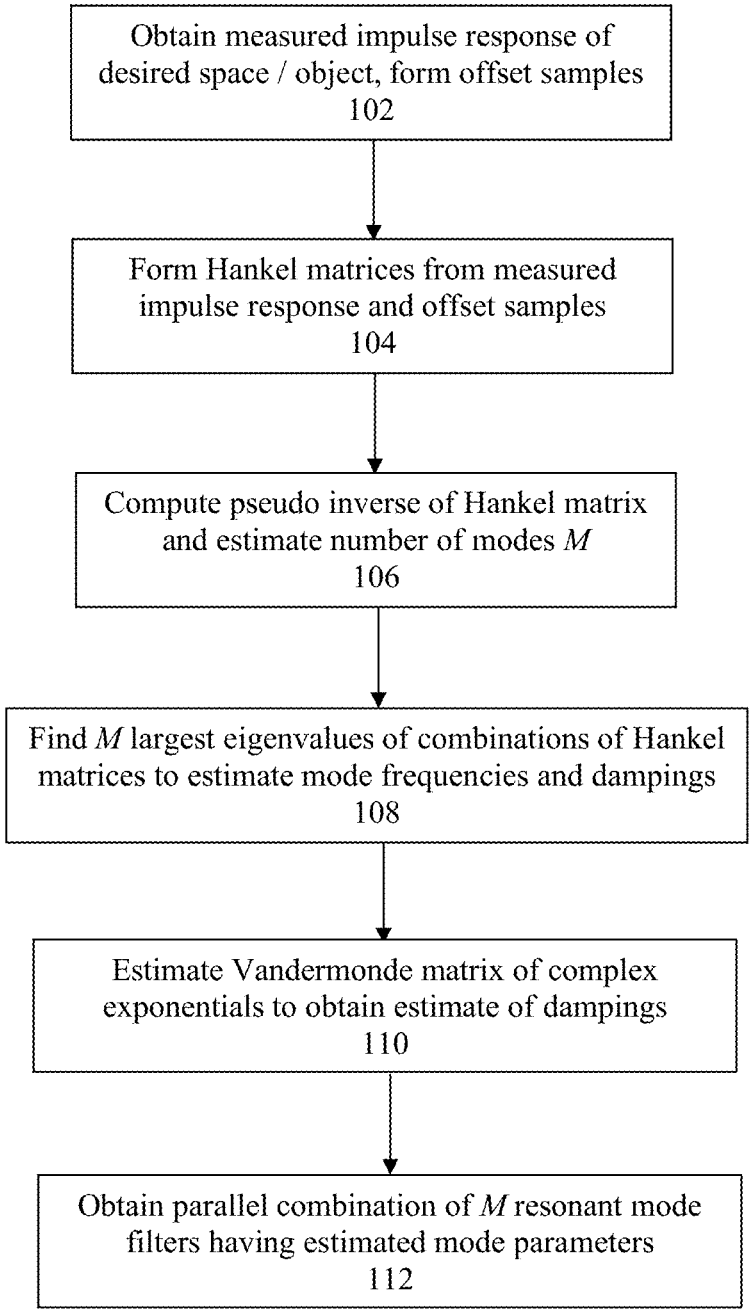
FIG. 1 is a flowchart illustrating an example methodology according to embodiments.

The present embodiments will now be described in detail with reference to the drawings, which are provided as illustrative examples of the embodiments so as to enable those skilled in the art to practice the embodiments and alternatives apparent to those skilled in the art. Notably, the figures and examples below are not meant to limit the scope of the present embodiments to a single embodiment, but other embodiments are possible by way of interchange of some or all of the described or illustrated elements. Moreover, where certain elements of the present embodiments can be partially or fully implemented using known components, only those portions of such known components that are necessary for an understanding of the present embodiments will be described, and detailed descriptions of other portions of such known components will be omitted so as not to obscure the present embodiments. Embodiments described as being implemented in software should not be limited thereto, but can include embodiments implemented in hardware, or combinations of software and hardware, and vice-versa, as will be apparent to those skilled in the art, unless otherwise specified herein. In the present specification, an embodiment showing a singular component should not be considered limiting; rather, the present disclosure is intended to encompass other embodiments including a plurality of the same component, and vice-versa, unless explicitly stated otherwise herein. Moreover, applicants do not intend for any term in the specification or claims to be ascribed an uncommon or special meaning unless explicitly set forth as such. Further, the present embodiments encompass present and future known equivalents to the known components referred to herein by way of illustration.

According to certain aspects, the present applicant recognizes aspects of Hankel norm filter design (e.g. J. Smith, Techniques for System Identification and Filter Design with Application to the Violin. Ph.D. dissertation, Stanford University, Stanford, Calif., 1983, § 1.3), in which the impulse response samples are arranged in a Hankel matrix, and a rational system is fit to a reconstruction of the matrix using its largest singular values. The present applicant further recognizes that the outer product of vectors of complex exponential samples is a Hankel matrix. In this way, the Hankel matrix of impulse response samples is seen to be an outer product of mode filter responses. The present applicant still further recognizes that a manipulation of the Hankel matrix, similar to that of ESPRIT (e.g., R. Roy and T. Kailath, "Esprit-estimation of signal parameters via rotational invariance techniques," IEEE Transactions on acoustics, speech, and signal processing, vol. 37, pp. 984-995, July 1989) can be used to generate the desired mode parameters.

Denote by h(t) an impulse response available at samples t=0, 1, . . . , T, with T being even. Assuming that h(t) is associated with a rational system without repeated poles, then it may be expressed as the sum of M mode responses $h_m(t)$, $$h(t) = \sum_{m=1}^{M} h_m(t), \tag{1}$$

in which each mode response is a complex exponential, $$h_m(t)=\gamma_m \exp\{j\omega_m-\alpha_m\}, \tag{2}$$

characterized by a mode frequency $\omega_m$, mode decay rate $\alpha_m$ and mode amplitude $\gamma_m$. The modal filter is this parallel combination of resonant mode filters. The goal, then, is to estimate the mode count M and mode parameters $\omega_m$, $\alpha_m$ and $\gamma_m$, m=1, 2, . . . M, to best approximate noisy observations of the impulse response:

$$\tilde{h}(t)=h(t)+n(t), \tag{3}$$

where n(t) represents additive measurement noise. It should be noted that embodiments will be described herein with reference to using an impulse response, those skilled in the art will appreciate that other types of responses could be used, such as selected portions of impulse responses (e.g. portions not starting at time zero).

Consider $v_m$, the stack of samples of the complex exponential portion of the mth mode response $h_m(t)$, and V, the concatenation of the $v_m$, $$V = [\, v_1 \;\; \ldots \;\; v_M \,], \tag{4}$$
$$v_m = \left[\, e^{(j\omega_m-\alpha_m)\cdot 0} \;\; \ldots \;\; e^{(j\omega_m-\alpha_m)\frac{T}{2}} \,\right]^{\bar{T}},$$

where $\cdot^T$ represents the non-Hermetian transpose. Note that the elements of the column $v_m$ form a geometric series, and as such its outer product (using a non-Hermetian transpose) forms a Hankel matrix, with elements $\exp\{j\omega_m-\alpha_m)\cdot t\}$ along the t-th antidiagonal, $$v_m v_m^T = \begin{bmatrix} e^{(j\omega_m-\alpha_m)\cdot 0} & e^{(j\omega_m-\alpha_m)\cdot 1} & e^{(j\omega_m-\alpha_m)\cdot 2} & \ldots & e^{(j\omega_m-\alpha_m)\cdot T/2} \\ e^{(j\omega_m-\alpha_m)\cdot 1} & e^{(j\omega_m-\alpha_m)\cdot 2} & & & \vdots \\ e^{(j\omega_m-\alpha_m)\cdot 2} & & & \ddots & \vdots \\ \vdots & & & & \ddots \\ e^{(j\omega_m-\alpha_m)\cdot T/2} & \ldots & & \ldots & e^{(j\omega_m-\alpha_m)\cdot T} \end{bmatrix}. \tag{5}$$

Accordingly, the Hankel matrix formed by the impulse response samples H, $$H = \begin{bmatrix} h(0) & h(1) & h(2) & \ldots & h(T/2) \\ h(1) & h(2) & & & \vdots \\ h(2) & & \ddots & & \vdots \\ \vdots & & & \ddots & \\ h(T/2) & \ldots & \ldots & & h(T) \end{bmatrix}, \tag{6}$$

may be written as an outer product of V with a diagonal matrix of mode amplitudes, $\Gamma=\mathrm{diag}\{[\gamma_1 \ldots \gamma_M]\}$ $$H=V\Gamma V^T \tag{7}$$

In this way, the unknown mode amplitudes are separated from the unknown mode frequencies and dampings.

Following an approach similar to that of ESPRIT, the Hankel matrix formed using the impulse response offset by p samples, $K_p$, $$H=\begin{bmatrix} h(p) & h(p+1) & h(p+2) & \dots & h(p+T/2) \\ h(p+1) & h(p+2) & & & \vdots \\ h(p+2) & & \ddots & & \vdots \\ \vdots & & & \ddots & \\ h(p+T/2) & \dots & \dots & & h(p+T) \end{bmatrix}, \tag{8}$$

may also be written as an outer product, $$Kp=V\Psi_p\Gamma V^T \tag{9}$$

where $\Psi_p$ is a diagonal matrix of mode exponential kernels, $$\Psi_p=\mathrm{diag}\{[e^{(j\omega_1-\alpha_1)p}\ \dots\ e^{(j\omega_1-\alpha_1)P}]\}. \tag{10}$$

Post-multiplying $K_p$ by the pseudoinverse of the matrix H, $$K_pH^+=V\Psi_pV^{-1} \tag{11}$$

produces a matrix with eigenvalues that are the desired mode exponential kernels, $e^{(j\omega^*-\alpha^*)}$. (Note that the same eigenvalues can be produced by pre-multiplying by $H^+$. Also note that these eigenvalues are the generalized eigenvalues of the pair ($K_p$, H).

Based on the foregoing observations and relationships, the following describes an example methodology of estimating the mode count M and mode parameters $\omega_m$, $\alpha_m$ and $\gamma_m$, m=1, 2, . . . M, from noisy observations of the impulse response h(t), as shown in FIG. 1.

In block 102, a measured impulse response of the acoustic space or resonating object (e.g. having T time domain samples) is obtained using many ways known to those skilled the art. From the measured impulse response, offset samples at offsets p are obtained, also using many ways known to those skilled in the art.

In block 104, form the Hankel matrices:

$$\tilde{H} \text{ and } \tilde{K}_p$$

from the measured impulse response and offset samples of the measured impulse response:

$$\tilde{h}(t),\ t=0,\ 1,\ \dots\ T \text{ and } \tilde{h}(t)^r,\ t=p,\ p+1,\ \dots\ \hat{p}+T;$$

respectively, using the equations (6) and (8) as set forth above.

In block 106, compute the pseudoinverse of the measured impulse response Hankel matrix:

$$\tilde{H}^+;$$

for instance by forming a singular value decomposition, and inverting the "signal" subspace of:

$$\tilde{H}.$$

The signal subspace may be defined to be that associated with the $\dot{M}$ largest singular values. It may also be found by dividing the singular values into two groups having larger and smaller singular values, respectively associated with "signal" and "noise" subspaces of:

$$\tilde{H}.$$

Here, the rank of the signal space is used as an estimate of the number of modes, $\dot{M}$.

In block 108, find the $\dot{M}$ largest eigenvalues of $$\tilde{K}_p\tilde{H}^+ \text{ or } \tilde{H}^+\tilde{K}_p,$$

denoted by $v_m$, m=1, 2, . . . , $\dot{M}$. The mode frequency and damping estimates are then the real and imaginary parts of the log eigenvalues, scaled by 1/p, $$\frac{1}{p}\ln v_m = j\hat{\omega}_m + \hat{\alpha}_m. \tag{12}$$

Finally, in block 110 estimate of the Vandermonde matrix of complex exponentials:

$$\hat{V}$$

either from the eigenvalue decomposition above, or directly using the estimated mode frequencies and dampings. The column of unknown dampings, γ can then be estimated by linear least squares fit to the measured impulse response. Denoting by $$\tilde{h}$$

the stack of measured impulse response samples, we have $$\hat{\gamma}=(\hat{V}^TW\hat{V})^{-1}V^TW\tilde{h}, \tag{13}$$

where W is a weighting matrix, used for instance to achieve a better fit to the impulse response onset relative to the tail, though the identity matrix W=I generally produces good results. The dampings may also be estimated as the diagonal elements of the matrix $$\hat{V}^{-1}\tilde{H}\hat{V}^{-T}. \tag{14}$$

The final result in block 110 is a modal filter (i.e. a transfer function h(t)) comprising a parallel combination of M resonant mode filters having the estimated mode parameters as described above. This modal filter can then be applied to an input signal x(t) to produce an output y(t) that has the desired reverberation effect associated with the target acoustic space or resonating object.

Aspects of the methods described herein are illustrated with reference to the example impulse response shown in FIGS. 2A (time domain) and 2B (frequency domain spectrograph). This example impulse response was generated by adding Gaussian noise to the impulse response of a feedback delay network (FDN) reverberator (e.g. V. Valimaki, J. Parker et al., "Fifty years of artificial reverberation," IEEE Transactions on Audio, Speech, and Language Processing, vol. 20, pp. 1421-1448, July 2012). The FDN reverberator has two groups of four delay lines with delays (in samples) of $$\tau=[3\ 7\ 10\ 12\ 19\ 22\ 43\ 44], \tag{15}$$

and a block Hadamard mixing matrix $$Q=I\otimes H_4/2, \tag{16}$$

where ⊗ represents the Kronecker product, and $H_4$ a 4×4 Hadamard matrix. The feedback filters are designed to give a constant reverberation time of 200 ms for the four shorter delay lines and a frequency-dependent reverberation time, varying between 400 ms at low frequencies and 100 ms at high frequencies, for the four longer delay lines, thus producing a two-stage decay.

Figures 2A, 2B:
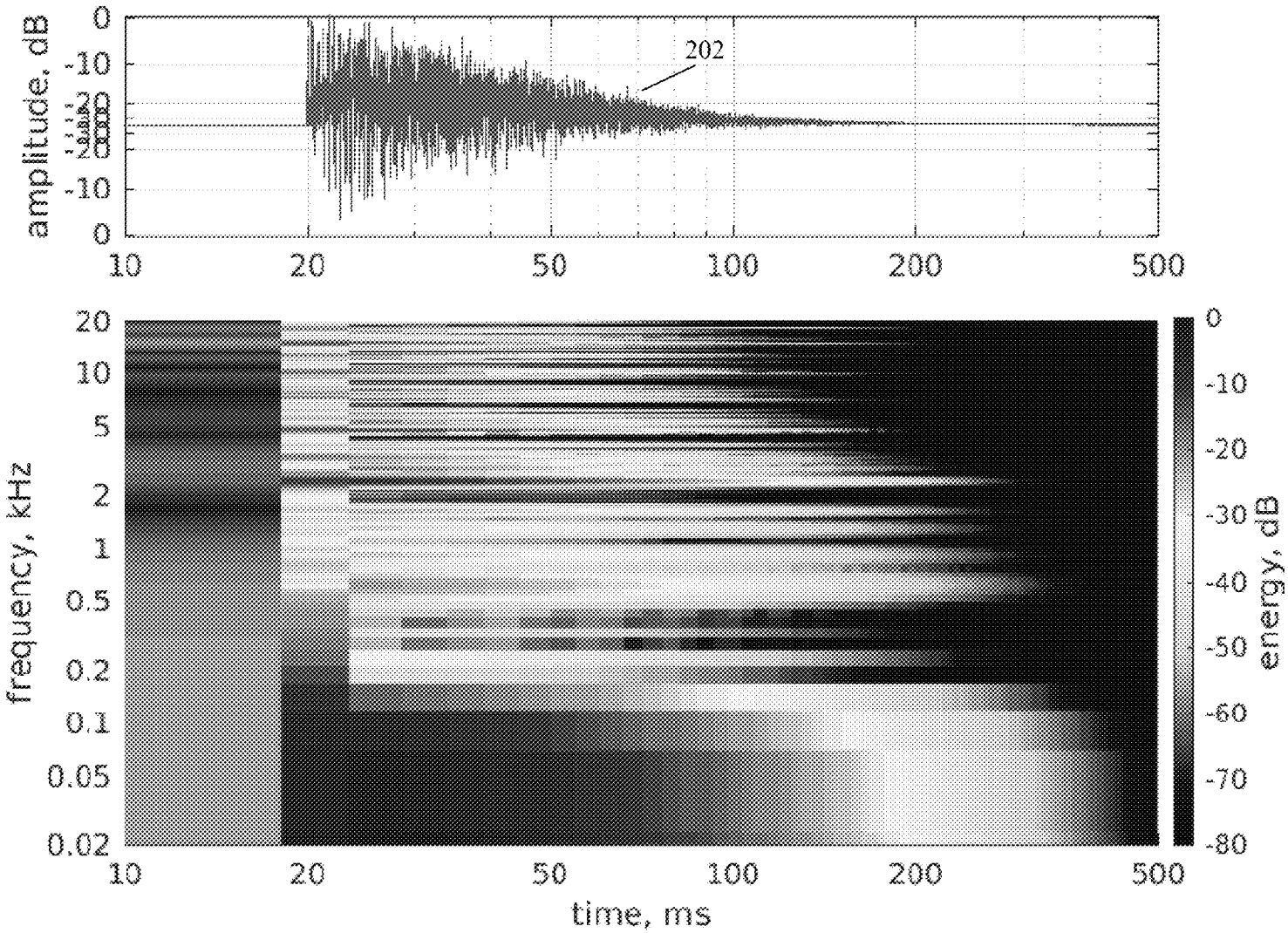
FIGS. 2A and 2B are plots illustrating an example impulse response (time domain) and corresponding spectrogram, respectively for a feedback delay network reverberator having two groups of four delay lines.
Figure 3A:
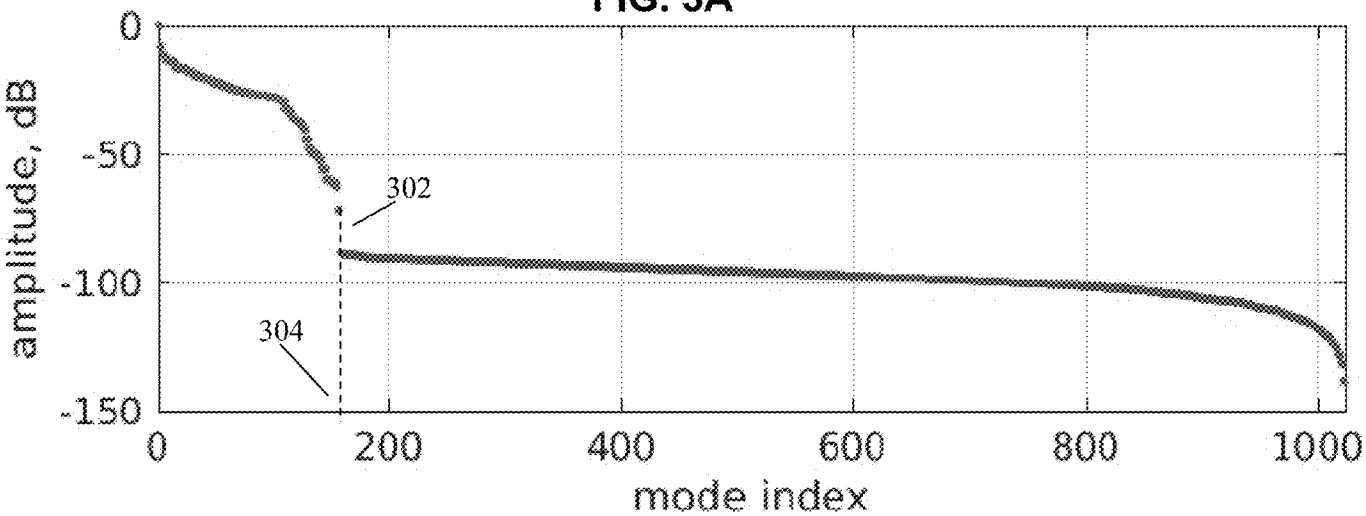
FIGS. 3A and 3B are plots showing example singular values of the Hankel matrix made from samples of the impulse response of FIG. 2A in additive white Gaussian noise and associated dampings, respectively.

White Gaussian noise was added at a level of −80 dB to the impulse response 202 of FIG. 2A to form a measured impulse response, $\tilde{h}$(t), the first 1025 samples of which are arranged to form the 1024×1024 Hankel matrices $\tilde{H}$ and $\tilde{K}_1$. The singular values of $\tilde{H}$ are shown in the FIG. 3A. A break point 302 between the signal and noise subspaces is evident, consistent with the additive noise level of −80-dB. The signal subspace 304 was rank 157 (used to estimate mode count M), close to the 160 delay line elements and four feedback filter states present, and suggesting a modest overlap in delay line length multiples.

Figure 3B:
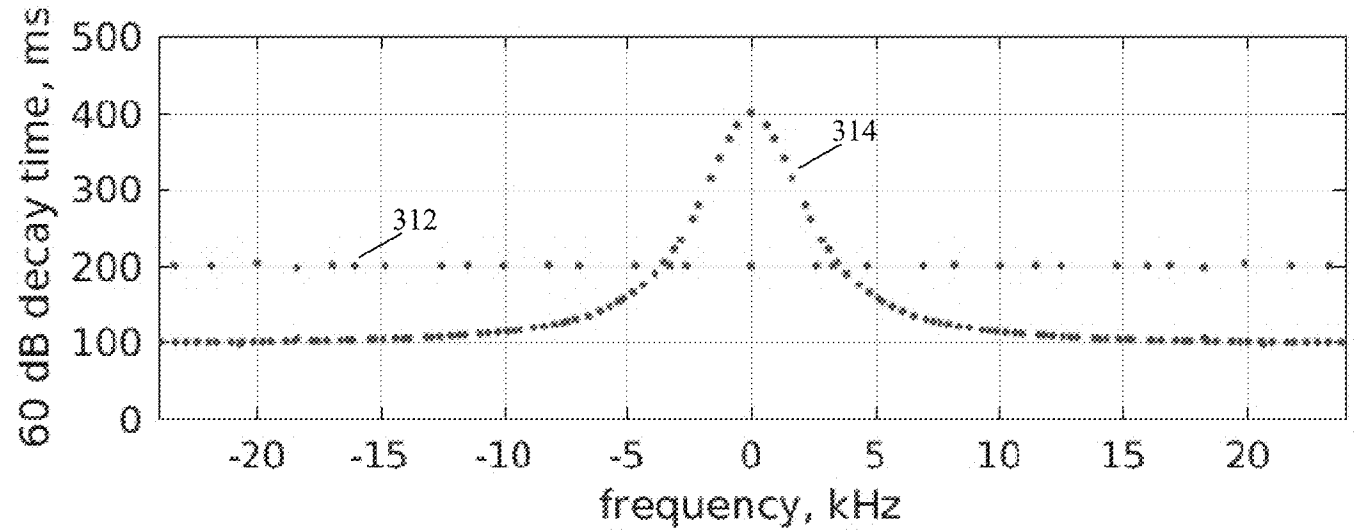

The signal subspace of $\tilde{H}$ was inverted, and the generalized eigenvalues between $\tilde{K}_1$ and $\tilde{H}$ computed to estimate the mode frequencies $\hat{\omega}_m$ and decay times $\hat{\alpha}_m$ (cf. (12)). The mode frequencies are represented by the x-axis values of the sample points in FIG. 3B. Note that the constant 412 and frequency-dependent 414 decay times associated with the different feedback delay network blocks are reproduced by the estimated decay times.

Figure 4A:
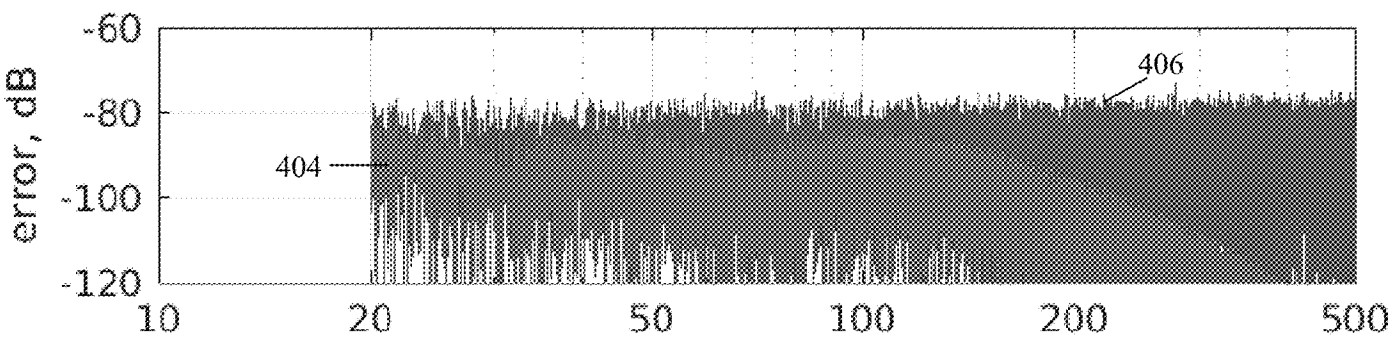
FIGS. 4A and 4B are plots illustrating errors between the estimated and noise-free impulse response, and between the measured and noise-free impulse response, as well as the impulse response of the modal filter designed using the estimated mode frequencies, dampings, and amplitudes overlaid on the noise-free impulse response, respectively.
Figure 4B:
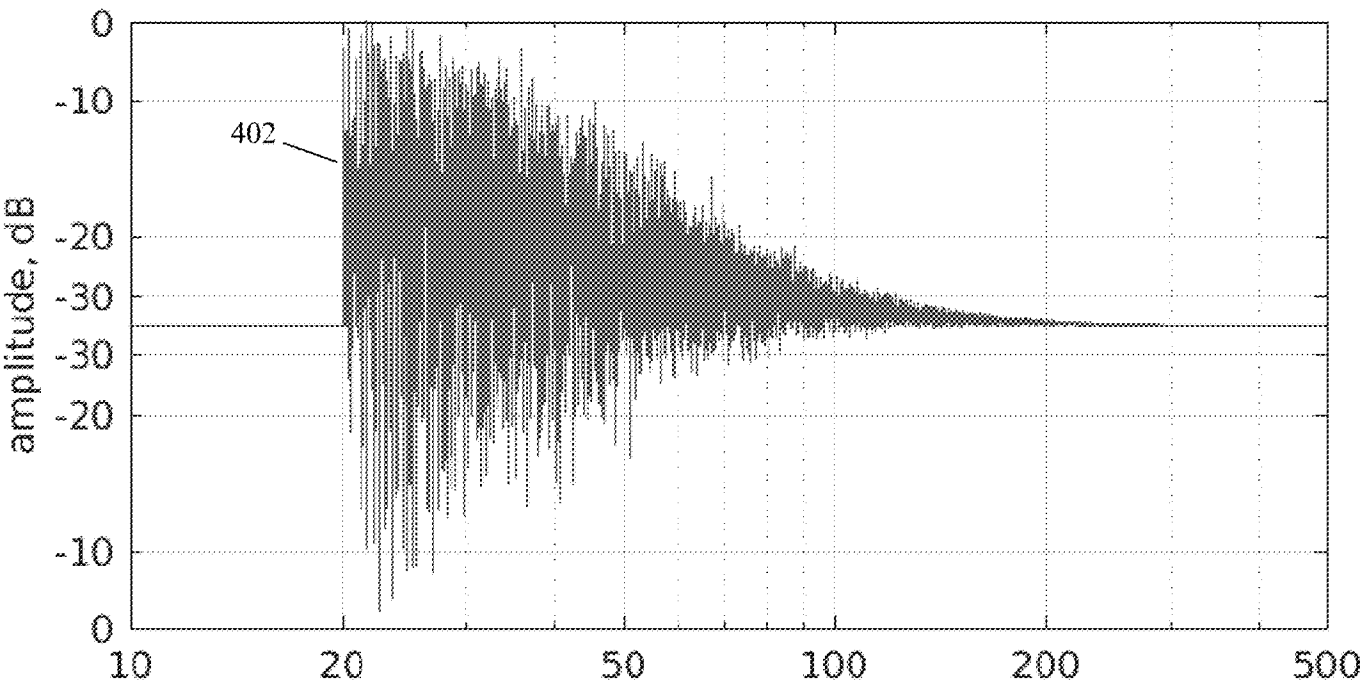

The mode dampings $\gamma_m$ were estimated using unweighted least squares, (13) with W=I. The impulse response 402 of the modal filter designed using the estimated mode parameters is overlaid on the noise-free impulse response in FIG. 4B, with the impulse response error shown in FIG. 4A. The estimated impulse response error 404 of the embodiments is slightly less than the −80 dB measurement noise level 406 at the impulse response onset, and decreases over time with the impulse response decay.

Finally, it should be pointed out that in the absence of noise, the estimated impulse response differs from the given impulse response to within numerical error, in excess of 200 dB below the impulse response onset level. Similarly, mode frequencies and dampings computed from a state-space models of FDN reverberatory were seen to match those estimated from the noise-free impulse response to within $1\times e^{-11}$.

To get a feel for the statistical behavior of the inventive method, 256-trial Monte Carlo simulations were run using a four-state FDN reverberator made using the four shorter delay lines above, a Hadamard mixing matrix, a constant 60 dB decay time of 200 ms, and a sampling rate of 48 kHz. White Gaussian noise was added to the FDN impulse response at levels of (−50, −60, −70, −80) dB relative to the initial impulse response level to form the measured impulse responses for each trial. Modal filter impulse response, and modal frequency, damping, and amplitude estimates were made using the first 2049 measured impulse response samples.

Figure 5:
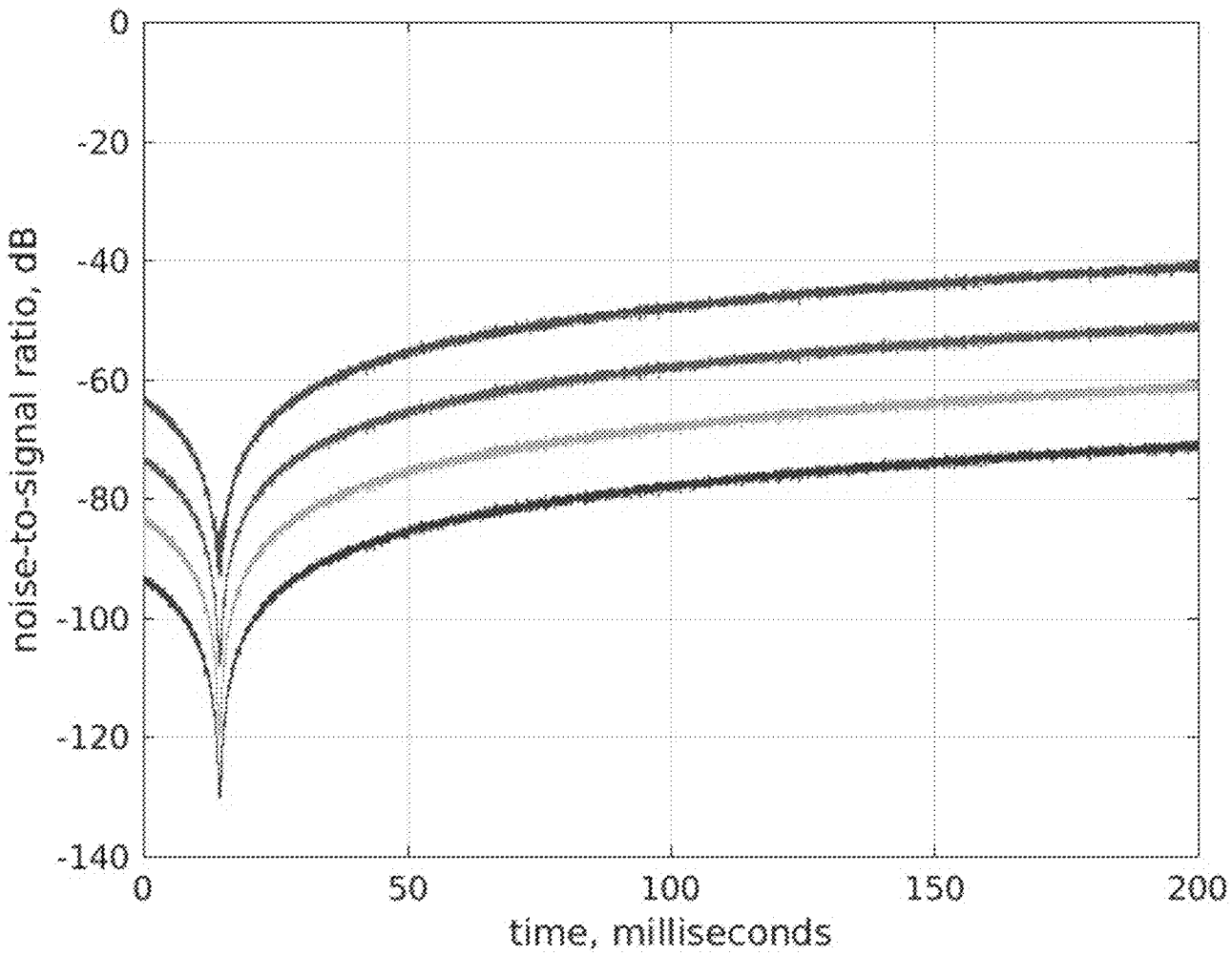
FIG. 5 is a plot illustrating impulse response estimate mean square error relative to the impulse response level as a function of time, expressed as a "noise-to-signal ratio," for measured impulse response additive noise levels of (−50, −60, −70, −80) dB.

FIG. 5 shows impulse response estimate mean square error relative to the impulse response level as a function of time for each of the additive noise levels. The impulse response estimates maintain a relatively constant signal-to-noise ratio over the 200 ms decay time of the FDN reverberator, with an increased signal-to-noise level at the impulse response onset. The technique appears to be operating in the small-error region, as each additional 10 dB of noise adds a corresponding 10 dB of estimate error over the range studied.

Figure 6A:
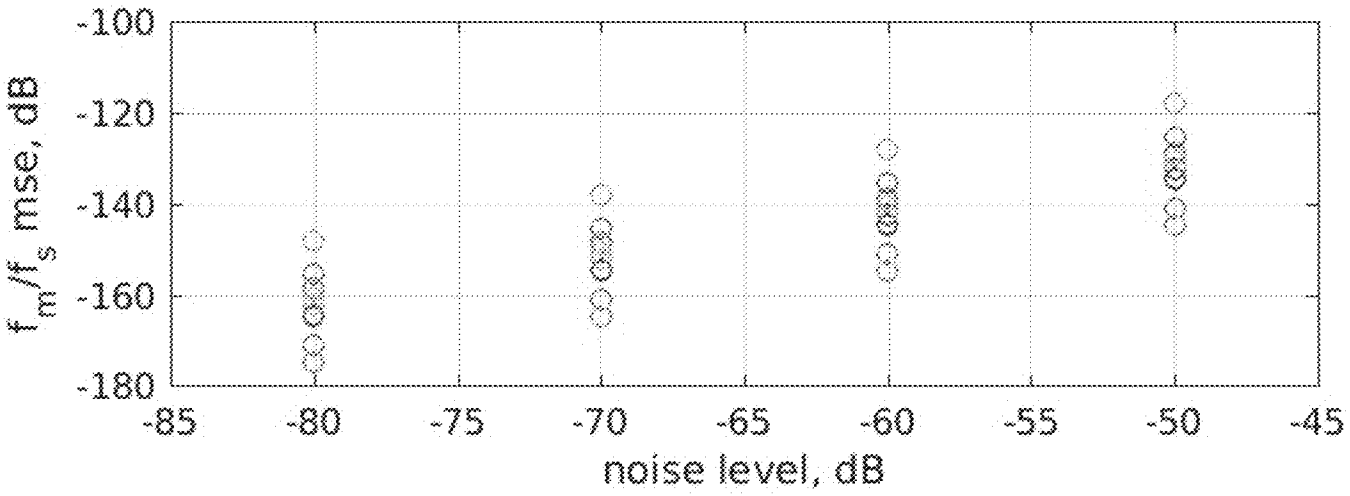
FIGS. 6A and 6B are plots illustrating mode frequency and mode damping estimate mean square errors, respectively for measured impulse response additive noise levels of (−50, −60, −70, ¬80) dB.
Figure 6B:
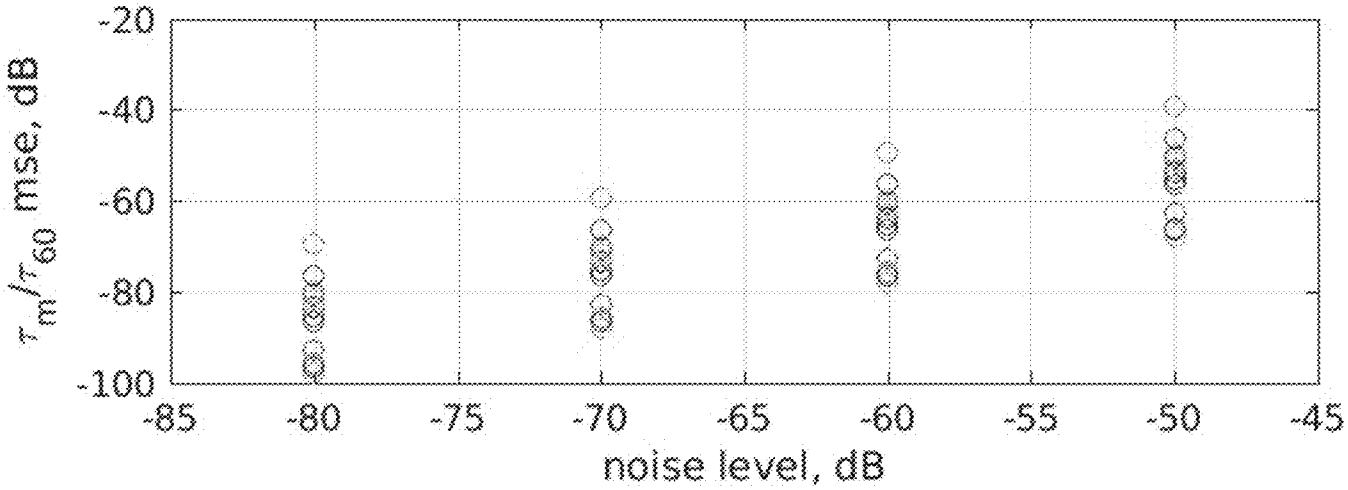

FIGS. 6A and 6B show the corresponding mode frequency and mode damping estimate mean square errors, respectively. The mode frequencies and decay times appear to be accurately estimated, again with each additional 10 dB of noise level adding 10 dB to the estimate mean square error.

In many scenarios, the mode frequencies and decay times (or dampings) are of primary importance. In these cases, it is possible to work from only a portion of the impulse response, and even the response of the system being modeled to any terminating signal. Such system responses are available in room acoustics measurement scenarios such as when a balloon pop, hand clap, or interrupted noise responses are available. Here, as the input is zero after some point in time, the system is responding with the sum of its mode exponentials, with perhaps unknown mode amplitudes. In these cases, applying the methods described herein to the system response when the system input is zero can produce meaningful mode frequency and damping estimates.

In a similar scenario, the system might have a number of long-lasting modes and many short-duration modes. In this case, it would be possible to estimate the parameters of the long-lasting modes by applying the inventive techniques to the portion of the impulse response when only the long-lasting modes are present, i.e., after the shorter-duration modes have sufficiently decayed. Here, the mode complex amplitudes can be adjusted to start at any desired time. Such a design could be used with a hybrid implementation in which a convolutional or similar efficient method is used to model the quickly decaying portion of impulse response, and a modal approach is used to implement the long-lasting modes.

Other aspects of the inventive method are motivated by the fact that there are a number of modal filter design scenarios in which there are many, long-lasting modes. To accurately estimate the mode frequencies and dampings in these scenarios, it desired to use a sufficiently long portion of the impulse response that a number of cycles of the low-frequency modes and a good amount of decay of the long-lasting modes can be captured. Also to provide the needed statistical leverage, the number of impulse response samples used should be at least several times the number of modes.

For example, an impulse response measured from a small recital hall could have a 60 dB decay time of about a second, and have several thousand modes in the audio band. An impulse response length of $\tau$=16384 could be needed. In addition to being computation-ally expensive, numerical issues can arise with such large matrices. To circumvent these difficulties, the impulse response may be processed separately in a set of frequency bands.

The idea is to bandpass filter and down-sample the impulse response for each of a set of overlapping bands. In this way, each band will contain relatively few modes and last a relatively short number of down-sampled samples. The mode frequencies and dampings in each band may be estimated using the techniques described above, and translated to the original sampling rate and frequency band accordingly. (Note that the modes associated with the bandpass filtering will appear in the band mode parameter estimate, and should be discarded.) The mode amplitudes may be estimated, for instance, by least squares as described above, using the measured impulse response and estimated mode frequencies and dampings.

Figure 7:
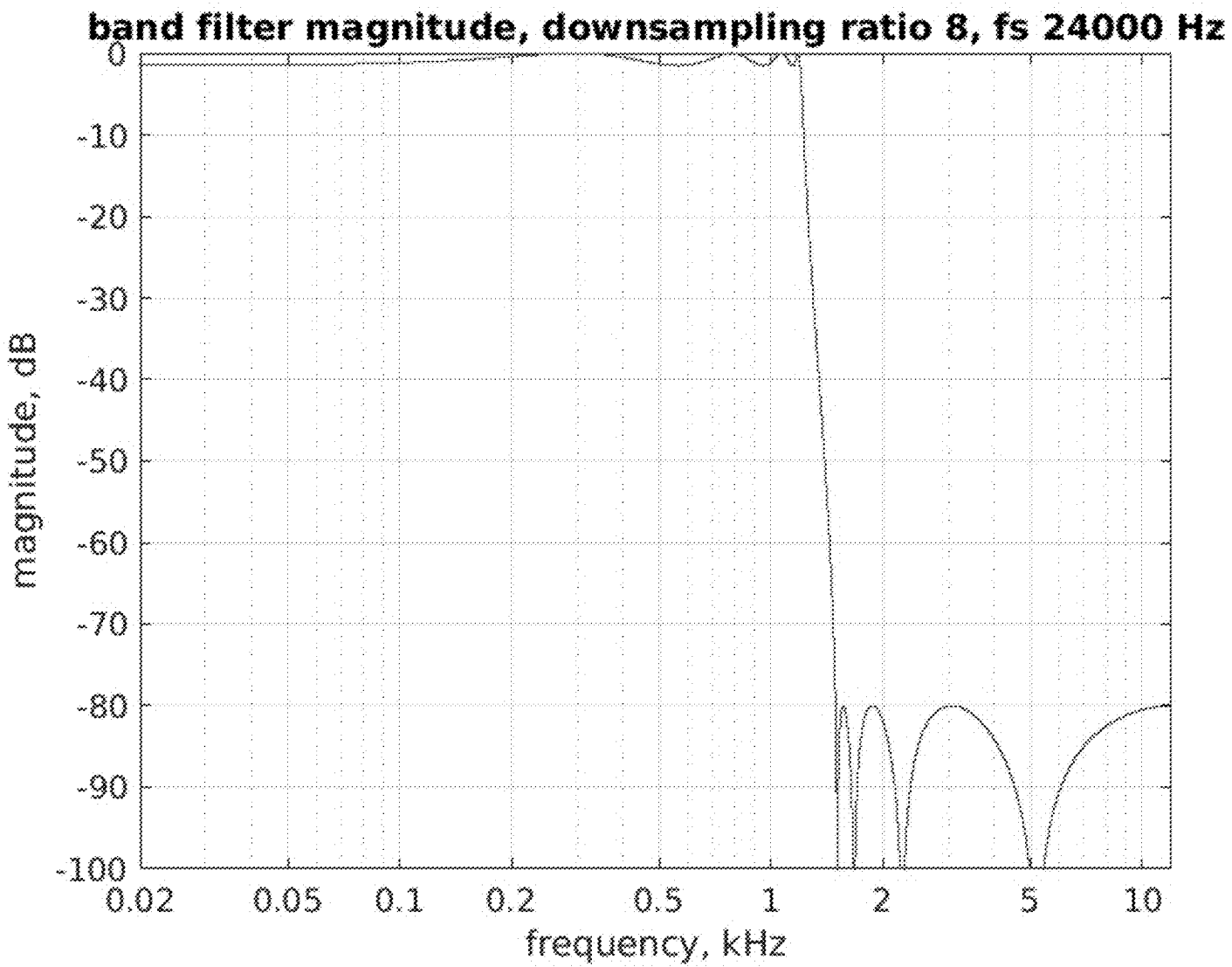
FIG. 7 is a plot illustrating a response of an example band low-pass filter.
Figure 8A:
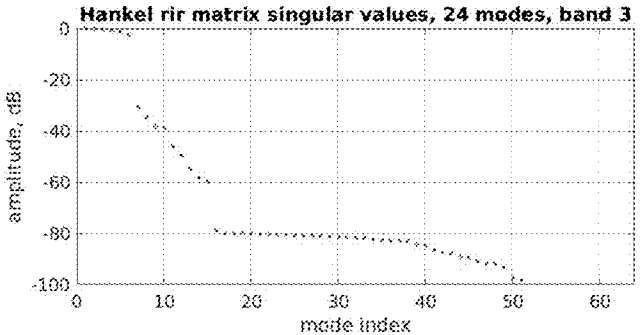
FIGS. 8A to 8C are plots illustrating aspects of an example band modal model.
Figure 8B:
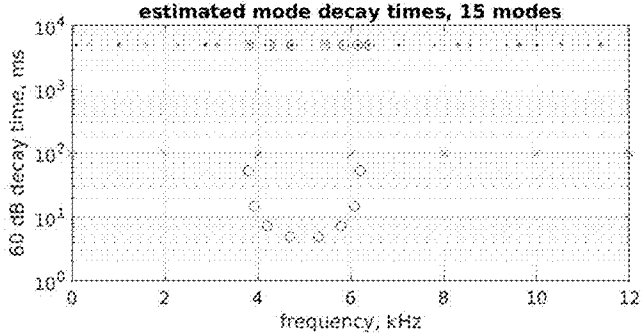
Figure 8C:
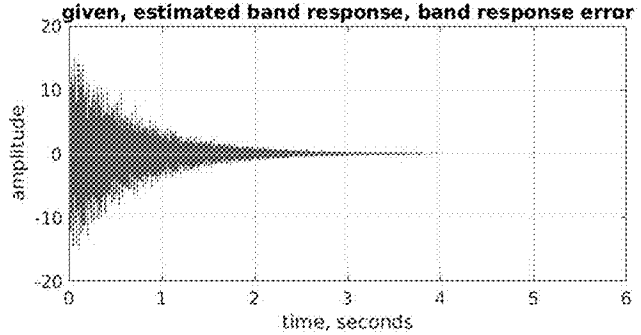
Figure 9A:
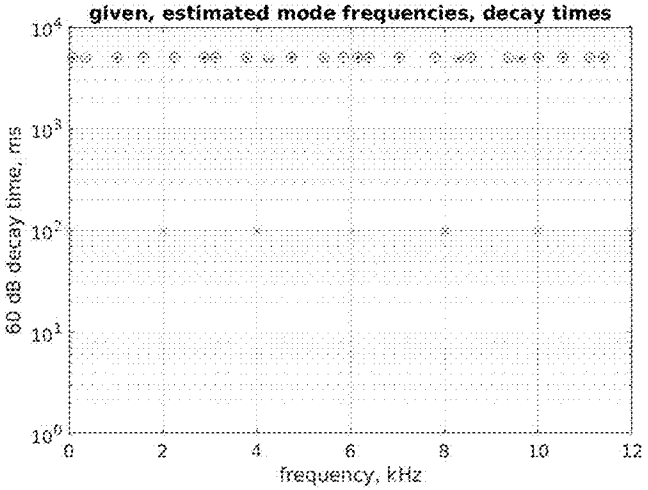
FIGS. 9A and 9B are plots illustrating aspects of an example modal design according to embodiments.
Figure 9B:
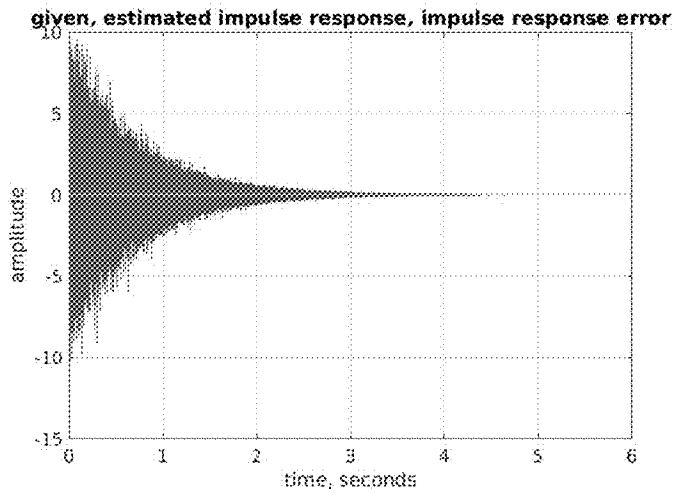

This processing is illustrated with respect to a synthesized impulse response having 24 modes randomly distributed across a 12 kHz wide band, each having a 60 dB decay time of 5000 ms. A modal model is designed by processing the impulse response in bands using heterodyning and the elliptic low-pass filter shown in FIG. 7. The filter provides a sufficiently narrow bandwidth that a down-sampling ratio of 8 may be used, thus reducing the length in samples of the decay time and the dimension of the Hankel matrices formed by factors of 8, and providing bands that were 2 kHz wide. A typical band design is shown in FIGS. 8A-8C. The Hankel matrix singular values, evaluated in forming the pseudo-inverse, are shown in FIG. 8A. A clear separation between the "signal" and "noise" subspaces is evident. The modeled mode frequencies and decay times are displayed as circles in FIG. 8B; the mode frequencies and dampings used to generate the noisy impulse response are shown as dots. Note that the measured mode frequencies and decay times are well modeled for the modes in that band, with the dots and circles aligning. Note also that there are a set of modeled modes forming a somewhat circular grouping with small decay times. These modes are associated with the elliptic band filter, and can be discarded. The modeled band mode frequencies and dampings were used to estimate the band mode gains, and model the band impulse response, as shown in FIG. 8C; note the close match between the given and modeled band impulse responses. Finally, the band designs were combined, and the resulting mode frequencies and dampings were used to estimate via least squares the mode gains and the impulse response shown in FIGS. 9A and 9B, respectively.

An example system according to embodiments can be included in a sound editing application and implemented by a plug-in in a digital audio workstation (DAW).

Such an example system can includes a filter design module and a modal reverberator module. The filter design module receives a measured impulse response for a room or resonating object to be modeled. For example, the DAW can include a library of measured responses from which a desired response can be selected. As another example, the measured response can be directly obtained using techniques known to those skilled in the art. Using the measured response, the design module then generates the parameters for the modal reverberator, specifically the mode frequencies, dampings and amplitudes for each of the M resonant mode filters using the example methodology described in connection with FIG. 1 above.

The reverberator module effectively implements the modal filter formed by the M resonant mode filters, so as to apply artificial reverberation to a source signal that yields an output signal having reverberation characteristics matching the desired acoustic space or resonating object. It should be noted that the filter design module and reverberator module are not necessarily included in the same system in all embodiments.

In one example implementation, a system according to embodiments is included in a computer configured with DAW software such as Digidesign Pro Tools that supports plugin applications (e.g. AU, VST, RTAS compatible plugins), and possibly having a DSP card (not shown) that accelerates plugin processing. One possible example of a card and corresponding plugin application that can be adapted for use with this invention is UAD-1 DSP card and plugin bundle from Universal Audio of Santa Cruz, Calif. In such an example, the modal reverb techniques of the present invention are included as one plug-in application, or one application of among many plug-in applications provided with the card. In one example embodiment, the computer is a Mac or PC having a processor such as an Intel Pentium or other Intel CPU, AMD Athlon or other AMD CPU, or a Power-compatible CPU.

Audio (either provided within or to the system in real-time or via recorded media) can be processed by the DAW using the plug-in application and the techniques of the present invention. The plug-in application can further allow a user, via a user interface such as a graphical display, mouse, keyboard, etc., to select and adjust the parameters used by the designs and reverberating modules (e.g. selecting desired impulse responses, adjusting number of modes, extension controls, etc.), which can further cause the DAW to process the audio with the desired effect. Those skilled in the art will be able to understand how to implement the embodiments using software written in accordance with the methodologies described herein for use in a DAW after being taught by the present disclosure.

Although the present embodiments have been particularly described with reference to preferred examples thereof, it should be readily apparent to those of ordinary skill in the art that changes and modifications in the form and details may be made without departing from the spirit and scope of the present disclosure. It is intended that the appended claims encompass such changes and modifications.

What is claimed is:

1. A method of obtaining parameters of a modal filter, comprising:

identifying an impulse response for a target acoustic space or resonating object, the impulse response having first and second different sets of samples;

forming Hankel matrices using the identified impulse response, wherein forming includes forming a first Hankel matrix using only the first set of samples of the impulse response and forming a second Hankel matrix using only the second set of samples of the impulse response; and using the Hankel matrices, including the formed first and second Hankel matrices, to identify the parameters of the modal filter, wherein the modal filter is configured to be applied to an input audio signal so as to produce an output audio signal.

2. The method of claim 1, wherein using the one or more Hankel matrices includes generating an inverse matrix of one of the one or more Hankel matrices.

3. The method of claim 2, further comprising determining a rank of the inverse matrix to estimate a number of modes of the modal filter.

4. The method of claim 1, wherein using the one or more Hankel matrices includes generating eigenvalues based on the one or more Hankel matrices.

5. The method of claim 4, further comprising estimating one or both of mode frequencies and dampings of the modal filter using the eigenvalues.

6. A method of obtaining parameters of a modal filter, comprising:

identifying an impulse response for a target acoustic space or resonating object;

forming one or more Hankel matrices using samples of the identified impulse response; and using the one or more Hankel matrices to identify the parameters of the modal filter, wherein the modal filter is configured to be applied to an input audio signal so as to produce an output audio signal, wherein using the one or more Hankel matrices includes performing a least squares fit using estimates of mode frequencies and damping parameters of the modal filter to obtain estimates of mode amplitudes of the modal filter.

7. The method of claim 6, wherein using the one or more Hankel matrices includes generating an inverse matrix of one of the one or more Hankel matrices.

8. The method of claim 7, further comprising determining a rank of the inverse matrix to estimate a number of modes of the modal filter.

9. The method of claim 6, wherein using the one or more Hankel matrices includes generating eigenvalues based on the one or more Hankel matrices.

10. The method of claim 9, further comprising estimating one or both of mode frequencies and dampings of the modal filter using the eigenvalues.

11. A method of obtaining parameters of a modal filter, comprising:

identifying an impulse response for a target acoustic space or resonating object;

processing the impulse response to form a plurality of frequency subbands of the impulse response;

forming one or more Hankel matrices using samples of respective frequency subbands of the identified impulse response; and using the one or more Hankel matrices to identify the parameters of the modal filter, wherein the modal filter is configured to be applied to an input audio signal so as to produce an output audio signal.

12. The method of claim 11, wherein using the one or more Hankel matrices includes generating an inverse matrix of one of the one or more Hankel matrices.

13. The method of claim 12, further comprising determining a rank of the inverse matrix to estimate a number of modes of the modal filter.

14. The method of claim 11, wherein using the one or more Hankel matrices includes generating eigenvalues based on the one or more Hankel matrices.

15. The method of claim 14, further comprising estimating one or both of mode frequencies and dampings of the modal filter using the eigenvalues.

* * * * *